US007789329B2

(12) United States Patent
Klein

(10) Patent No.: US 7,789,329 B2
(45) Date of Patent: Sep. 7, 2010

(54) FILTERING APPARATUS FOR INLET FLUID INTO A PRESSURE CHAMBER OF A SPRAYER

(75) Inventor: Gregory Allen Klein, East Amherst, NY (US)

(73) Assignee: Chapin Manufacturing, Inc., Bathavia, NY (US)

( * ) Notice: Subject to any disclaimer, the term of this patent is extended or adjusted under 35 U.S.C. 154(b) by 60 days.

(21) Appl. No.: 12/150,660

(22) Filed: Apr. 29, 2008

(65) Prior Publication Data

US 2009/0266917 A1 Oct. 29, 2009

(51) Int. Cl.
*B05B 1/14* (2006.01)
*F23D 14/68* (2006.01)
*A62C 11/00* (2006.01)

(52) U.S. Cl. ..... 239/590; 239/329; 239/575; 239/302; 239/337

(58) Field of Classification Search ..... 239/329, 239/462, 553, 575, 590; 210/416.1, 470, 210/471

See application file for complete search history.

(56) References Cited

U.S. PATENT DOCUMENTS

| | | | | |
|---|---|---|---|---|
| 1,081,648 A | * | 12/1913 | Adams | 210/434 |
| 3,788,484 A | * | 1/1974 | Godin | 210/447 |
| 4,688,643 A | * | 8/1987 | Carter et al. | 169/33 |
| 4,702,416 A | | 10/1987 | Pagliai et al. | |
| 4,702,419 A | | 10/1987 | Luchsinger | |
| 4,753,723 A | * | 6/1988 | Willinger | 210/167.23 |
| 4,768,714 A | | 9/1988 | Luchsinger | |
| 4,798,333 A | | 1/1989 | Luchsinger | |
| 5,335,853 A | | 8/1994 | Wirz | |

(Continued)

FOREIGN PATENT DOCUMENTS

EP 445989 A2 * 9/1991

*Primary Examiner*—Len Tran
*Assistant Examiner*—James S Hogan
(74) *Attorney, Agent, or Firm*—Kenneth J. Lukacher; Martin Lukacher

(57) ABSTRACT

A backpack sprayer having a tank with a filling opening at the top thereof and a pressure chamber therein is provided with filtering apparatus for preventing particles in the fluid in the tank from entering an inlet port of the pressure chamber located near the bottom of the tank when suction generated by a pump that depends from the bottom of the pressure chamber causes fluid in the tank to flow through the inlet port into the pressure chamber. The fluid pressurized by the pump flows through an outlet port from the pressure chamber for spraying when a valve in the nozzle at the end of a hose communicating with the outlet port is actuated by an operator. The filtering apparatus is provided by a filter in a frame removably captured in a fixture projecting outwardly from the outside of the pressure chamber on opposite sides of the inlet port. A handle extends from the frame upwardly along the outside of the pressure chamber a sufficient distance to be accessed manually when the hand of the operator extends through the filling opening of the tank. The filter prevents particles, such as sediment, in the liquid at the bottom of the tank from flowing into the pressure chamber and pump mechanism thereof thereby preventing clogging of the pump mechanism and interfering with operation of the sprayer. The filter may be manually removed from the fixture for cleaning and then replaced. The need to totally disassemble the sprayer for cleaning is thereby substantially eliminated.

6 Claims, 5 Drawing Sheets

U.S. PATENT DOCUMENTS 5,603,361 A * 2/1997 Cuisinier ..... 141/26
5,671,884 A * 9/1997 Restive ..... 239/154
5,961,048 A * 10/1999 Prieschl et al. ..... 239/146
6,412,707 B1 7/2002 Wirz
6,440,303 B2 8/2002 Spriegel
7,028,925 B2 * 4/2006 Guest et al. ..... 239/526
7,100,540 B2 * 9/2006 Vaughan ..... 122/40
7,222,389 B2 * 5/2007 Morgan et al. ..... 15/320

* cited by examiner

FILTERING APPARATUS FOR INLET FLUID INTO A PRESSURE CHAMBER OF A SPRAYER

The present invention relates to filtering apparatus (and method) for inlet fluid into the pressure chamber of a sprayer, and particularly from fluid filling a tank in which the pressure chamber is disposed. The invention is especially suitable for use in a backpack or knapsack sprayer wherein the tank and pressure chamber are parts thereof.

The backpack sprayers in which the filtering apparatus provided by the invention may be deployed and may suitably be of a design described in Luchsinger, U.S. Pat. No. 4,702,419, issued Oct. 27, 1987. Such sprayers have a tank which is filled with liquid to be sprayed through a filling opening at the top thereof. A pressure chamber is disposed extending upwardly from the bottom of the tank toward the filling opening and a pump which is reciprocally actuated by a crank mechanism connected to structure depending from the bottom of the tank. The tank, pressure chamber, and pumping mechanism of such backpack sprayers are also shown in Wirz, U.S. Pat. Nos. 5,335,853, issued Aug. 9, 1994, and 6,412,707, issued Jul. 2, 2002. Liquid is drawn into the pressure chamber, via an inlet port, and pressurized fluid is withdrawn for spraying from an outlet port from the pressure chamber. These ports may be cyclically opened and closed on the suction and pressure cycle of the pump by check valves of the pump mechanism as shown and described in the above referenced patents. Particles, such as in sediment collected in the tank, can flow with the sprayer liquid into the pressure chamber and clog the pump mechanism, especially the check valves thereof. Preventing the infusion of unwanted particles, sediment and the like is a problem adversely effecting the operation of sprayers wherein a pressure chamber is inside the tank. The need to reduce the infusion of such particles, and especially sediment, in the tank into the pressure chamber and the pump mechanism has been heretofore recognized, and schemes for agitating the fluid at the bottom of the tank has, for example, utilizing a special agitation chamber associated with the pump mechanism, have been proposed; for example, in Luchsinger, U.S. Pat. Nos. 4,768,714, issued Sep. 6, 1988, and 4,798,333, issued Jan. 17, 1989.

Heretofore, removal of particles and other undesirably material clogging the pumping mechanism has required disassembly of the entire sprayer, flushing out the collected material and then reassembling the sprayer. It is desirable to avoid the use of agitation mechanisms as well as the total disassembly and assembly of the entire sprayer. It would be desirable to filter inlet fluid into the pressure chamber inlet port so that it does not reach the pumping mechanism or the pressure chamber. Filters have been proposed for use in sprayer especially of the type having a discharge tube, which extends to the bottom of the sprayer and is in communication with the spraying hose and nozzle. See, for example, Spriegel, U.S. Pat. No. 6,440,303, issued Aug. 27, 2002. The problem of accommodating filtering apparatus in a backpack sprayer is exacerbated by the confined space between the walls of the tank and the pressure chamber inside the tank of the sprayer.

A filter apparatus which may be removed for cleaning and replaced manually by the operator is provided in a sprayer having a tank with a pressure chamber therein, all in accordance with the invention, thereby avoiding the need for hydraulic agitation or complete disassembly of the sprayer.

Accordingly, it is the principal object of the present invention to improve sprayers in which a pressure chamber is disposed inside a tank, which is filled with the spraying liquid, by providing filter apparatus accommodated inside the tank and which may be readily removable and replaceable manually, thereby avoiding the need to disassemble the entire sprayer for cleaning out of particles entering the pressure chamber and mechanism for pumping and pressurizing spraying liquid from the tank.

Another object of the invention is to improve backpack sprayers by incorporating therein filtering apparatus for preventing the flow of particles and similar contaminants with liquid entering the pressure chamber of the sprayer.

It is a further object of the invention to provide a filter for inlet fluid to the pressure chamber inside a tank of the sprayer, which is manually accessible through the filling opening of the tank to enable installation and removal of the filter, as for cleaning of material which may be trapped in the filter.

It is a still further object of the invention to provide removable and replaceable filtering apparatus which is manually accessible through the filing opening of a tank of a sprayer and reduces contamination due to particles and other solid contaminants at low cost without the need for disassembly and reassembly of the sprayer or the need to use special apparatus for agitating the liquid at the bottom of the sprayer tank.

Briefly described, a sprayer having a tank with a filling opening and having a pressure chamber inside the tank and an inlet port for the flow of liquid from the tank into the pressure chamber for pressurization is improved by filtering apparatus. The filtering apparatus removably locates a filter in the flow of the liquid into an inlet port from the tank into the pressure chamber. The filter is at the end of a handle, which is manually accessible via the filling opening of the tank for moving the filter into and out of filtering relationship with the inlet port and into and out of the tank, when it is desired to clean the filter of contaminating particles which may be trapped therein and to replace the cleaned filter back in the flow of liquid into the inlet port.

The invention also provides a method for filtering liquid to be sprayed in a sprayer having the steps of: placing a filtering element, such as a screen, near a liquid inlet port to the pressure chamber in the tank; providing a member external of the pressure chamber which extends from the filtering element to an end graspable by an operator; removing the filtering element from the tank by an operator via an opening of the tank with the aid of the member using the graspable end; cleaning material from the filtering element; and placing the cleaned filtering element via the opening of the tank back near the inlet port to the pressure chamber.

The foregoing and other objects and advantages of the invention, as well as a presently preferred embodiment of the invention will become more apparent from a reading of the following description in connection with the accompanying drawings in which.

Figure 1:
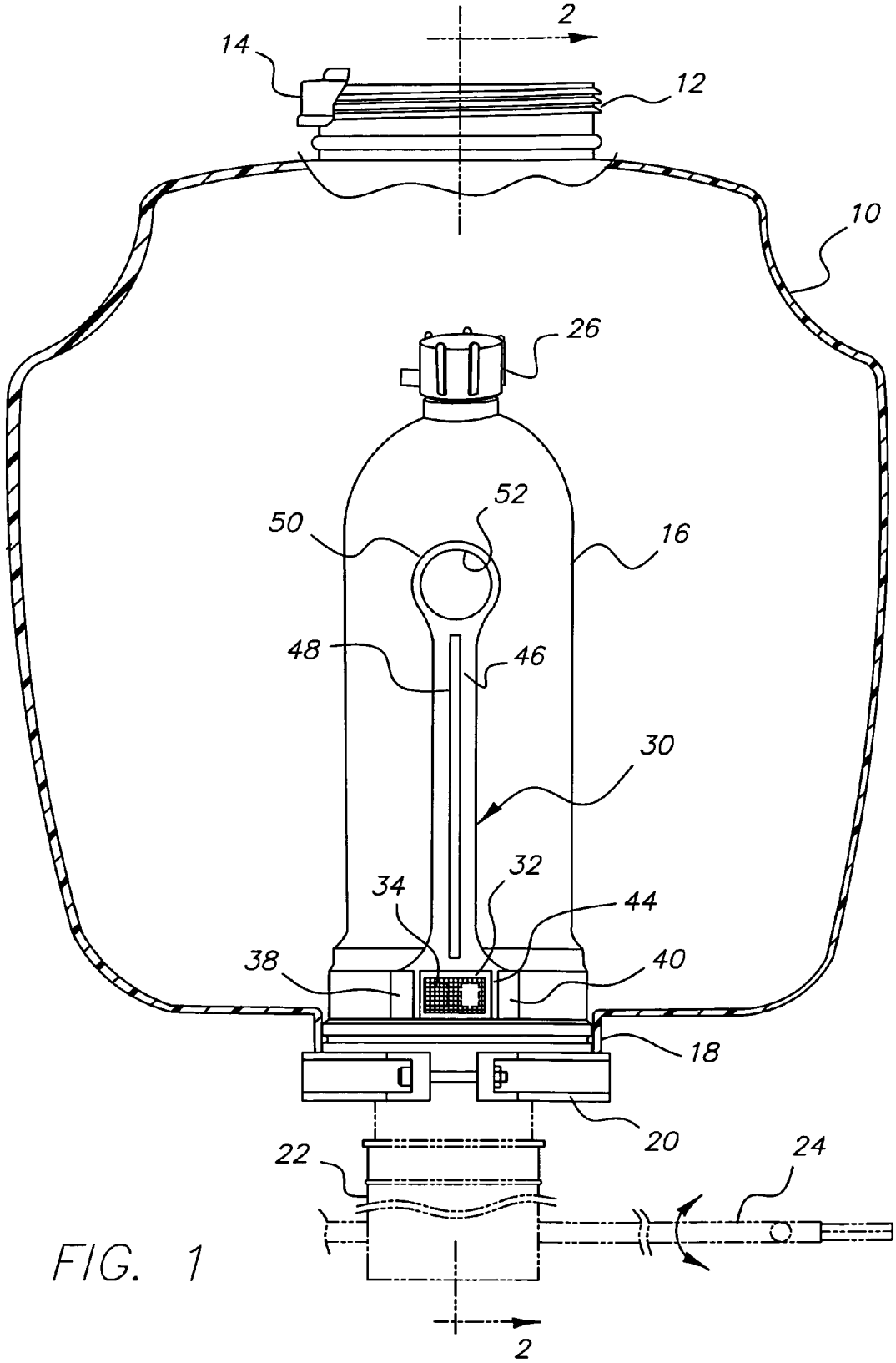
FIG. 1 is a sectional view from the front of a backpack sprayer having filtering apparatus in accordance with a presently preferred embodiment of the invention.

FIG. 1 illustrates a backpack sprayer of the type shown in the above referenced patents issued to Luchsinger and Wirz. The backpack sprayer includes a tank 10 having a filling opening 12 which is open for filling with liquid to be sprayed (i.e., poured into the tank) and then closed with a cap 14. A pressure chamber 16 is sealingly connected to the tank 10 in a flanged bottom opening 18 of the tank by a hose type clamp 20. Lips are provided in the bottom flange 18 of the tank 10 and on the bottom of the pressure chamber 16 which are engagable with the clamp 20 so as to position the pressure chamber in alignment inside the tank 10. As shown, the pressure chamber 16 may be a generally cylindrical vessel having its lower end. Depending from and preferably screwed into the pressure chamber is a pumping mechanism 22 which is reciprocated by a crank connected to a shaft 24. The support structure at the bottom of the tank and around the pump 22 is not shown to simplify the illustration, but may be similar to the support mechanisms shown in the above cited Luchsinger and Wirz patents.

The pressure chamber 16 may be provided with a relief valve 26, which is rotatable to relieve the pressure therein. Relief valve 26 may be of conventional design such as shown in U.S. Pat. No. 4,702,416, issued Oct. 27, 1987 to Pagliai and Luchsinger. The filter apparatus provided by the invention and the operation thereof is shown in FIGS. 1-5.

Figure 4:
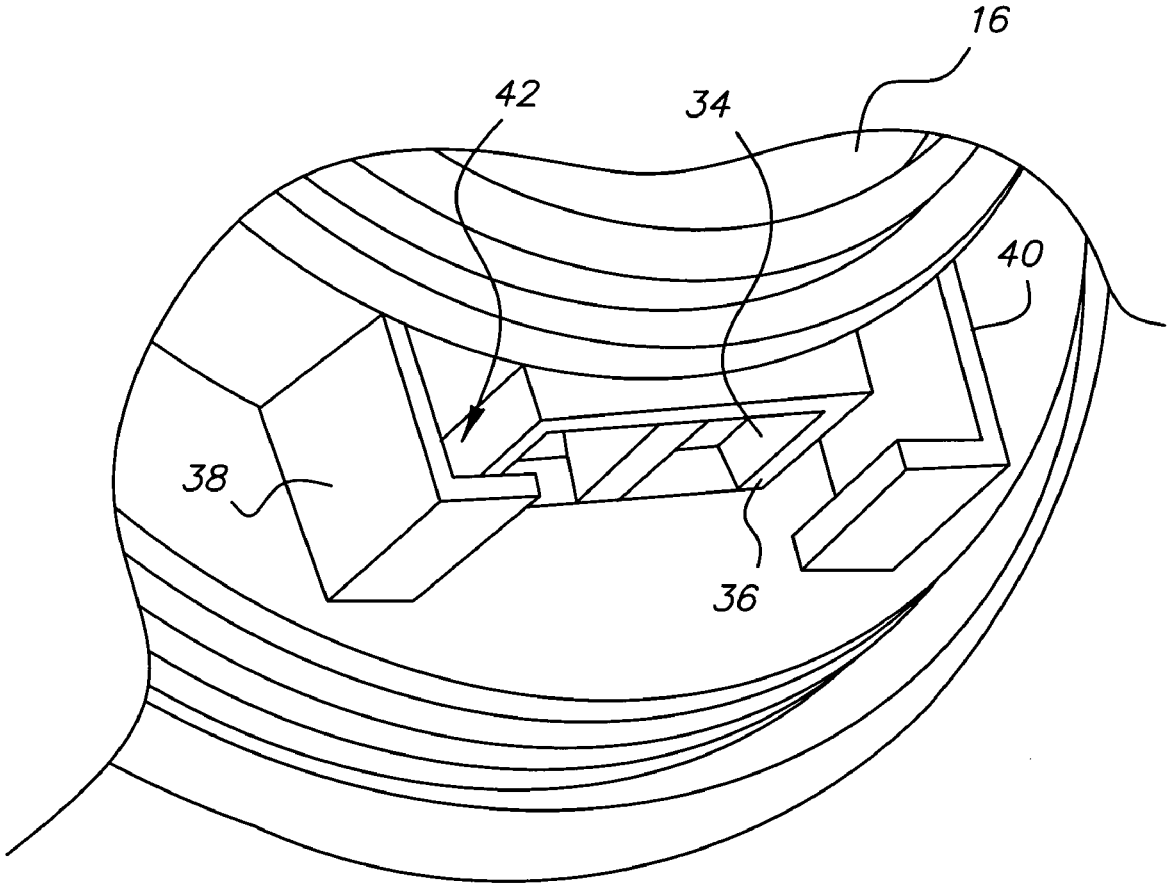
FIG. 4 is a fragmentary perspective view showing the fixture in which the filter is captured and located in proximity to the inlet port of the pressure chamber.
Figure 5:
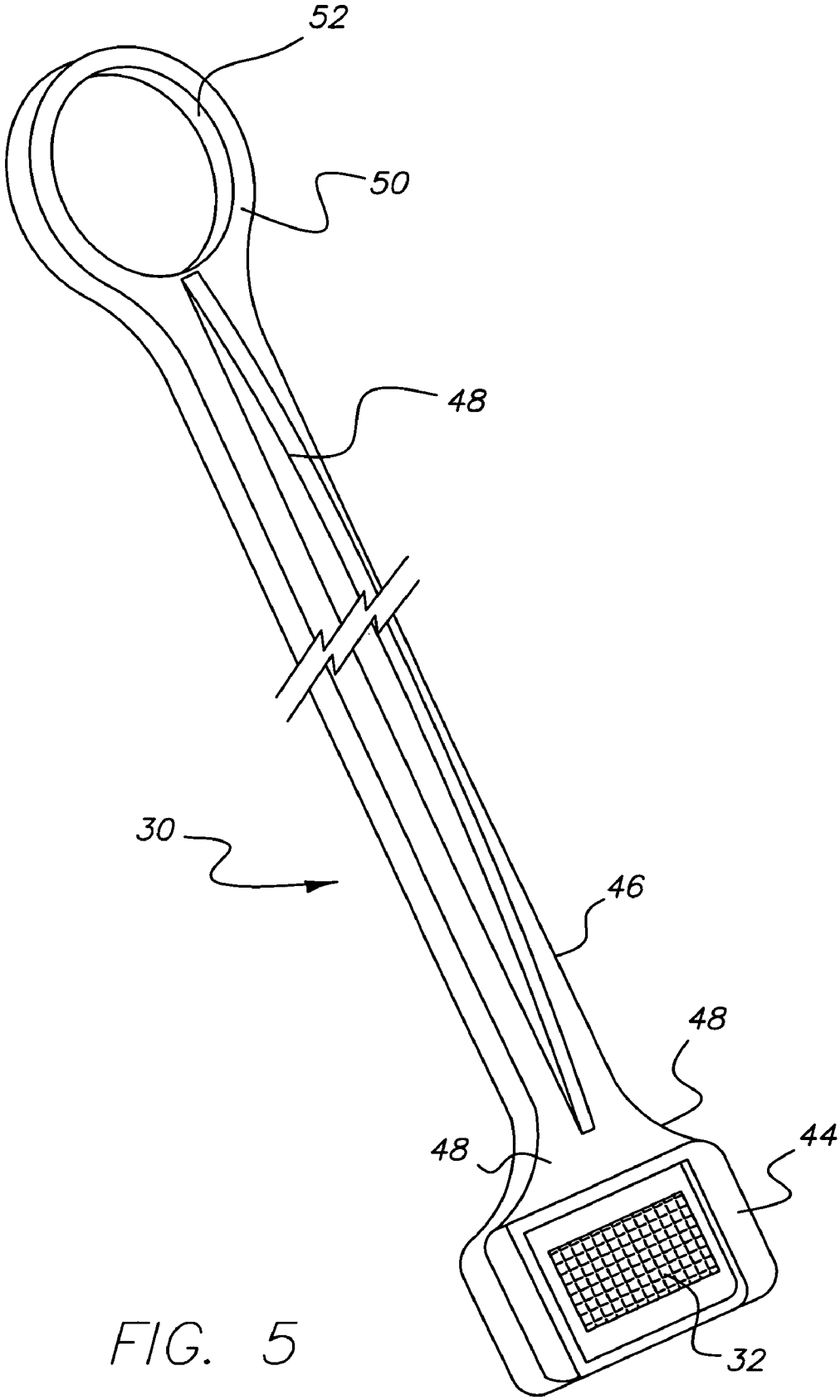
FIG. 5 is a perspective view of the filter apparatus including the frame carrying the filter screen and a handle extending upwardly from the frame, the handle having a manually graspable finger access hole.

Filtering apparatus 30 provided by this invention has a filter in the form of a screen 32 in proximity to, and preferably against an inlet port 34 provided by dual openings in a rectangular neck 36, projecting radially outward from the pressure chamber (see FIG. 4).

Also projecting outwardly from the pressure chamber 16 are flanged stubs 38 and 40 which provide a fixture 42 for capturing the removable filtering apparatus or filter 30. This filtering apparatus 30 also has a frame 44 in which the filter screen 32 is disposed and a handle 46 with a stem connected to the frame 44 and strengthened by gussets 48 (see especially FIG. 5). The upper end 50 of the stem of the handle 46 is enlarged to facilitate manual grasping of the handle, and may be provided with a finger access hole 52. Although a finger access hole 52 is preferred, other feature(s) facilitating operator grasping of upper end 50 of the filtering apparatus 30 may be used. Fixture 42 is sized to capture the frame 44 of filtering apparatus 30 and to enable removal there from when needed. The entire filter 30 may be a molded plastic part; the frame 44 and handle 46 all being molded together, as by injection molding. The screen 32 may be either a plastic or wire mesh with the wires sufficiently close to block contaminating particles in the flow into the inlet port 34 without interfering with the flow of the spray liquid. The frame 44 and handle 46 extending therefrom thus represents a member extending from one end with screen 32 to another end 50 graspable by an operator. The location of the filtering end of apparatus 30 provided by screen 32 is proximate to the bottom of the tank 10 facilitating filtering of material that may have settled at the bottom of the tank.

Figure 2:
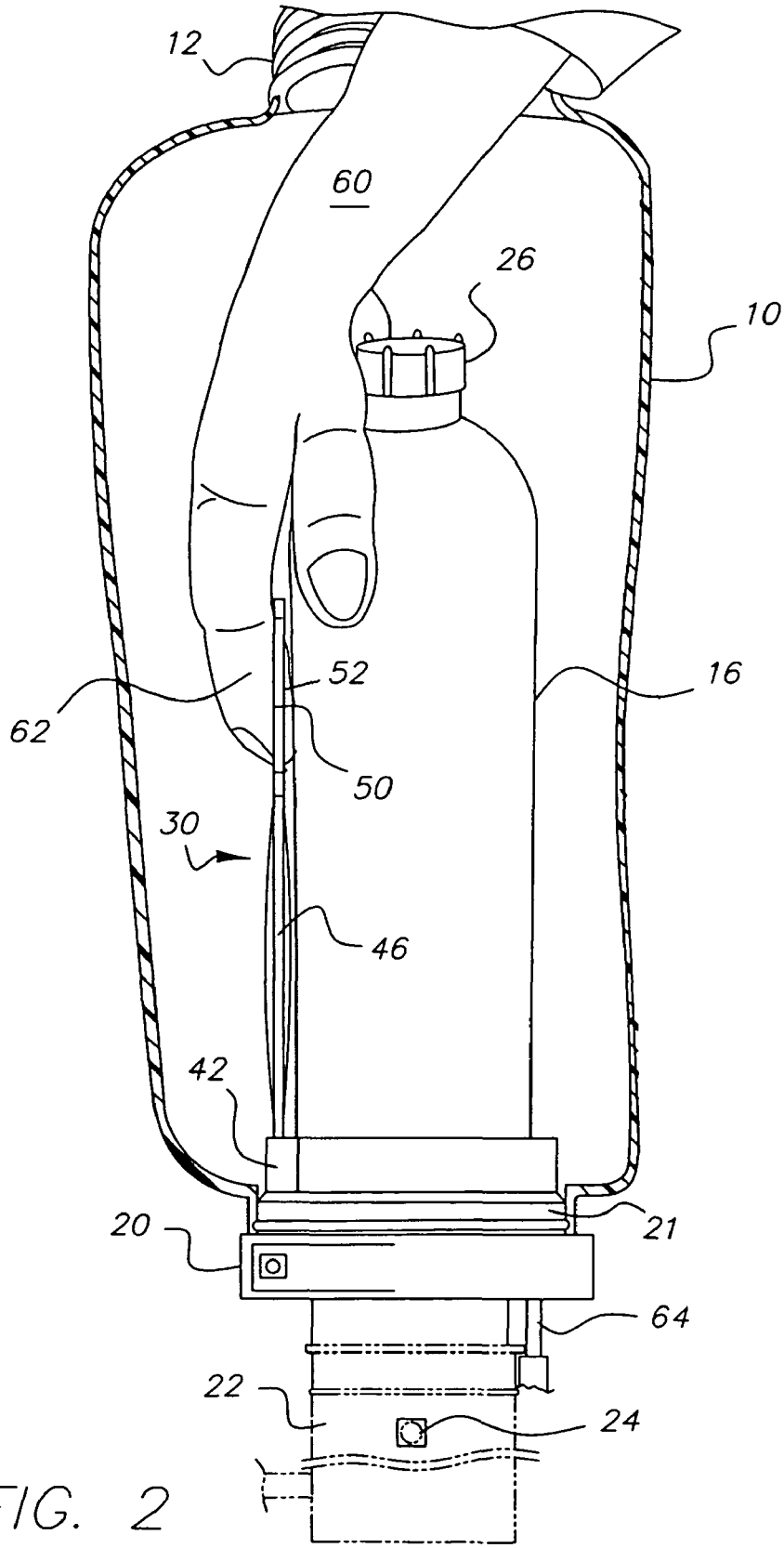
FIG. 2 is a sectional view along the line 2-2 in FIG. 1 showing how the filter apparatus is manually engaged for removal and installation thereof through the neck of the tank of the sprayer.
Figure 3:
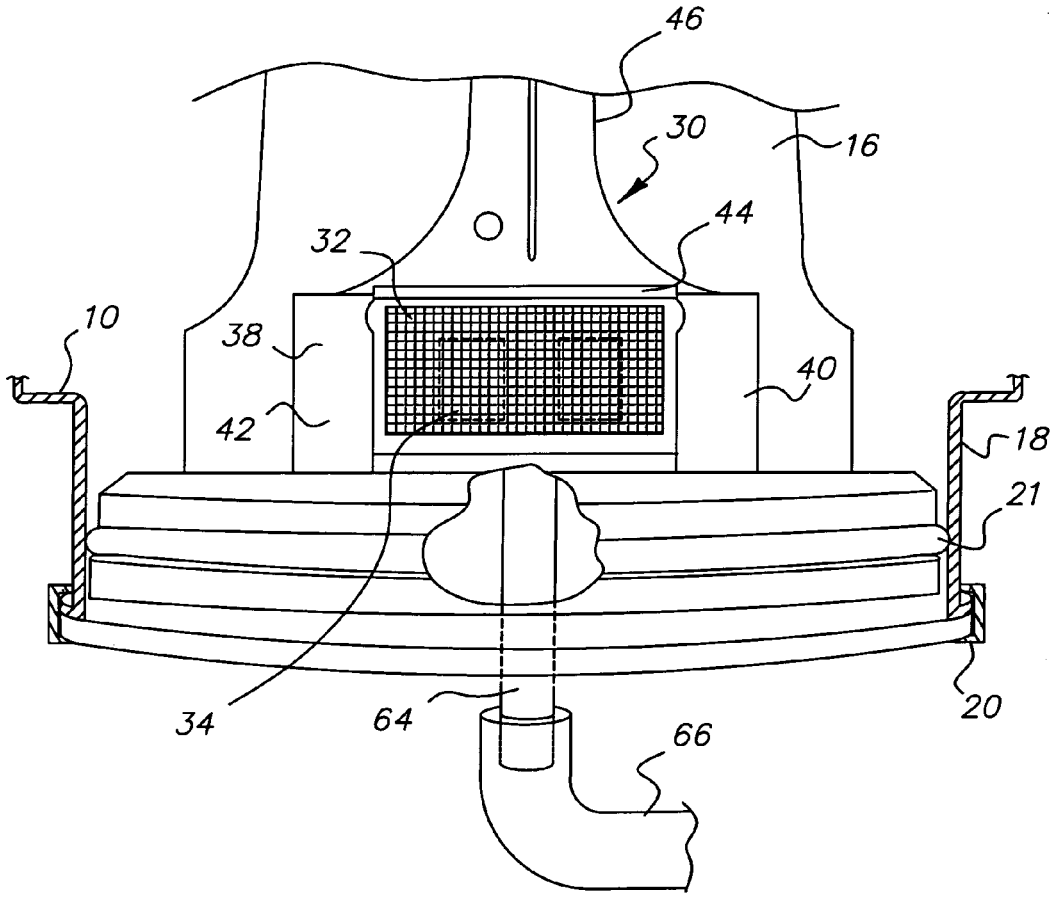
FIG. 3 is a fragmentary view of the filter installed in proximity to the inlet port of the pressure chamber of the sprayer.

As shown in FIG. 2, to access the filter 30, the hand 60 of the operator is inserted through the filling opening 12 of tank 10 so as to grasp the enlarged end 50 with the fingers 62 of the hand 60. One of the fingers 62 may be inserted into hole 52. The handle 46 extends sufficiently upwardly along the outside of the pressure chamber 16 to enable the hand 60 to access the filter 30 by reaching the handle 46. The frame 44 of the filter 30 may be removed from the notch in the fixture 42 and removed from the tank 10 so that the screen may be cleaned if necessary. The filter 30 is then reinstalled into the fixture 42 by the operator via opening 12.

During manipulation of the filter 30, the tank 10 remains assembled and sealed via the O-ring 21 which bears against the tank. Pressurized liquid in the pressure chamber 16 is accessed via an outlet port 64 connected to a sprayer hose 66 (see FIG. 3). The hose 66 is connected to a nozzle (not shown) with a valve which enables the pressurized fluid to enter the nozzle and be sprayed wherever the nozzle is pointed by the operator. Such nozzle may be typical of those used in backpack sprayers, as shown for example, in above referenced patents issued to Wirz.

From the foregoing description, it will be apparent that there has been provided a sprayer which is improved by a manually accessible filter in the tank which is removably disposed adjacent an inlet port to a pressure chamber for liquid from a tank in which the pressure chamber is disposed. Variations and modifications and other applications of the invention will undoubtedly become apparent to those skilled in the art. Accordingly, the foregoing description should be taken as illustrative and not in a limiting sense.

The invention claimed is:

1. In a sprayer having a tank having a filling opening through which a supply of liquid to be sprayed is poured into the tank, the sprayer also having a pressure chamber having an inlet port for flow of liquid from the tank via the inlet port into the chamber, the chamber also having an outlet port for liquid which is pressurized in the chamber, the improvement comprising a filter removably disposed inside said tank and adjacent the inlet port in the flow of liquid into the inlet port from the tank, the filter having a handle manually accessible via the filling opening of the tank and moveable into and out of filter relationship with the inlet port, wherein the filter comprises a frame having a filter element, said filter also being disposable into a holding fixture on said pressure chamber around said inlet port, said frame of said filter with said filter element being disposed between said tank and said inlet port on opposite sides of said filter element, and said tank has a top in which said filling opening is disposed and also having a bottom, said pressure chamber being a generally cylindrical vessel having a lower end attached to the bottom of said tank, said fixture being disposed in the proximity of the bottom of said tank to facilitate filtering of materials settling at the bottom of said tank, and said fixture comprises flanges defining a notch against said pressure chamber on the outside thereof which is of sufficient size to capture and hold said frame.

2. The improvement according to claim 1 wherein said handle provides a stem extending alongside the outside of said pressure chamber a sufficient distance to be reached by fingers of a hand extending into said filling opening.

3. The improvement according to claim 2 wherein said stem is enlarged at an upper end thereof for facilitating the grasping of said handle by said fingers to manipulate said filter into and out of said fixture.

4. The improvement according to claim 1 wherein said inlet port has a neck extending outwardly into said fixture against which said frame is disposed with said filter is captured in said notch provided by said fixture.

5. The improvement according to claim 3 wherein said enlarged end has a hole for access by one of said fingers on.

6. A sprayer comprising:

a tank having an opening to fill the tank with liquid to be sprayed;

pressurizing means having at least a chamber in the tank having an inlet port for passage of liquid in the tank into the chamber, a pump for generating flow of liquid from said tank into said chamber via said inlet port to pressurize said liquid in said chamber when said opening is closed, and an outlet port capable of passage of pressurized fluid from said chamber to be sprayed;

a filtering element disposed adjacent said inlet port for filtering material from liquid that enters the chamber, wherein said filtering element comprises a frame having said filter element; and means for enabling removal and reinstallation of said filtering element via said opening without disassembly of any part of said pressurizing means from said sprayer, wherein said means enabling removal and reinstallation of said filtering element comprises flanges defining a notch against said chamber on the outside thereof which is of sufficient size to capture and hold said frame.

* * * * *